United States Patent [19]

Wiebe

[11] 3,957,318

[45] May 18, 1976

[54] ELASTOMERIC RAILWAY TRUCK SIDE BEARING

[75] Inventor: Donald Wiebe, Sewickley, Pa.

[73] Assignee: A. Stuck, Company, Pittsburgh, Pa.

[22] Filed: May 16, 1974

[21] Appl. No.: 470,607

[52] U.S. Cl. ..... 308/138; 105/199 CB; 267/3; 267/9 A; 308/226

[51] Int. Cl.[2] ..... B61F 5/14; B61F 5/24; F16C 17/04; F16C 21/00

[58] Field of Search ..... 105/199 C, 199 CB, 206 R; 267/3, 9 A; 308/137, 138, 225, 226

[56] References Cited

UNITED STATES PATENTS

| | | | |
|---|---|---|---|
| 38,182 | 4/1863 | Sherman | 308/225 X |
| 710,609 | 10/1902 | Pungs | 308/225 |
| 1,831,926 | 11/1931 | O'Connor | 308/226 |
| 2,301,372 | 11/1942 | Cottrell | 308/138 |
| 3,255,712 | 6/1966 | Barber | 308/226 X |
| 3,295,463 | 1/1967 | Barber | 308/226 X |
| 3,556,503 | 1/1971 | Van Moss, Jr. | 267/3 |
| 3,628,464 | 12/1971 | Van Moss, Jr. | 308/138 X |
| 3,670,661 | 6/1972 | Pangalila | 105/199 CB X |
| 3,719,154 | 3/1973 | Reynolds | 105/199 CB |
| 3,796,167 | 3/1974 | Van Moss, Jr. | 105/199 CB |

*Primary Examiner*—Robert J. Spar
*Assistant Examiner*—Howard Beltran
*Attorney, Agent, or Firm*—Howard E. Sandler

[57] ABSTRACT

A railway truck side bearing and more particularly an improved side bearing utilizing elastomeric means and intermediate thereof a cylindrical rolled steel bearing means to control railway freight vehicle hunting.

14 Claims, 8 Drawing Figures

ELASTOMERIC RAILWAY TRUCK SIDE BEARING

Hunting in railway vehicles is the unstable cyclic yawing of trucks and the resulting side translation or oscillation of the railway car vehicle and is of particular significance when the car is traveling in an empty condition at relatively high speeds; for example, in excess of 45 miles per hour. The lateral track irregularities combined with conventional coned wheel configurations results in one side frame moving ahead of the other which in turn results in the flanges of the wheels striking and rubbing against the rails first on one side and then on the other thereby causing undesirable lateral car body oscillations and excessive truck component and rail wear. As the wheel treads and flanges wear, the tread conicity becomes more severe and the flange-rail clearance becomes larger thereby resulting in greater lateral excursions of the wheel sets during hunting and hence a more severe response occurs at an even lower speed. The lateral excursions can become sufficiently severe to possibly result in derailments.

Attempts were made heretofore to control hunting by utilizing resilient side bearings through frictional force obtained from a compressed or deflected resilient member. Such prior resilient side bearings consisted of either spring loaded steel elements or elastomeric blocks or columns or a combination of both. The spring loaded steel elements which utilize a steel on steel friction interface to control hunting quickly proved to be ineffective because of seizing and gulling thereby creating dangerously high shear forces having a potential to cause the truck to derail on curved track. On the other hand the elastomeric blocks offer the advantage of controlled friction at the side bearing interface, precluding seizing and creating a less rigid shear constraint which permits the truck to negotiate a minor lateral track irregularity without breaking friction at the side bearing-wear plate interface.

The elastomeric blocks utilized heretofore which were sufficiently resilient for the preload compression which is necessary to obtain consistent and reliable vertical biasing forces were subject to decomposition from internal heating and were generally too soft in shear to effectively restrain the truck for hunting control. If such elastomeric blocks were made sufficiently stiff in shear to control hunting they would be generally so stiff in compression that they would cause excessive weight transfer or concentration on one given side bearing thereby resulting in excessive shearing force which could possibly result in restraining the truck from swiveling in a manner to cause empty or loaded trucks to derail on short radius curved track.

By means of the present invention which includes a bearing block having an upper portion comprised of an elastomer having properties to frictionally restrain the car body from hunting while not being subject to heat decomposition and a lower portion adapted to be captively restrained and supported in a rigid cage and comprised of an elastomer being sufficiently resilient for preload compression necessary to obtain a consistent and reliable vertical biasing forces, the hereinabove mentioned problems of prior resilient side bearings are overcome or at least greatly alleviated.

It is to be noted that in addition to hunting it has been observed that in railway freight cars as described hereinabove, particularly with such freight cars having lubricated center plates, lateral motion of the car body with respect to the bolster occurs as a result of the lateral oscillation of the truck. Accordingly, it is still another object and advantage of this invention to restrain the lateral motion of the car body with respect to the bolster by the elastomeric block described hereinabove.

Most railway freight vehicles have the car bodies thereof supported by a center sill carried by a bolster which extends between a pair of spaced side frames. With such railway vehicles it is common practice to include a roller side bearing carried by the bolster intermediate the center sill and each adjacent side frame. The inclusion of such roller sill and each adjacent side frame. The inclusion of such roller side bearings is quite desirable to decrease the frictional resistance to swiveling which would otherwise greatly increase the problems of wheel flange wear, rail wear, train resistance and derailments which are all known to occur when substantial resistance to swiveling is present. Although roller side bearings having been quite effective in permitting the hereinabove mentioned translation between the railway truck body and the bolster such roller side bearings are of no effect in preventing or alleviating hunting.

Accordingly, it is still another object of the invention herein to provide a unitary roller side bearing assembly having elastomeric means disposed in the bearing channel intermediate the ends thereof and the roller bearing to alleviate the above mentioned problems due to hunting while simultaneously providing means for swiveling of the truck with respect to the car body as well as limiting the elastomer deformation under all extremely high side bearing load conditions.

These and other objects and advantages will become more readily apparent upon a reading of the following description and drawings in which.

Figure 1:
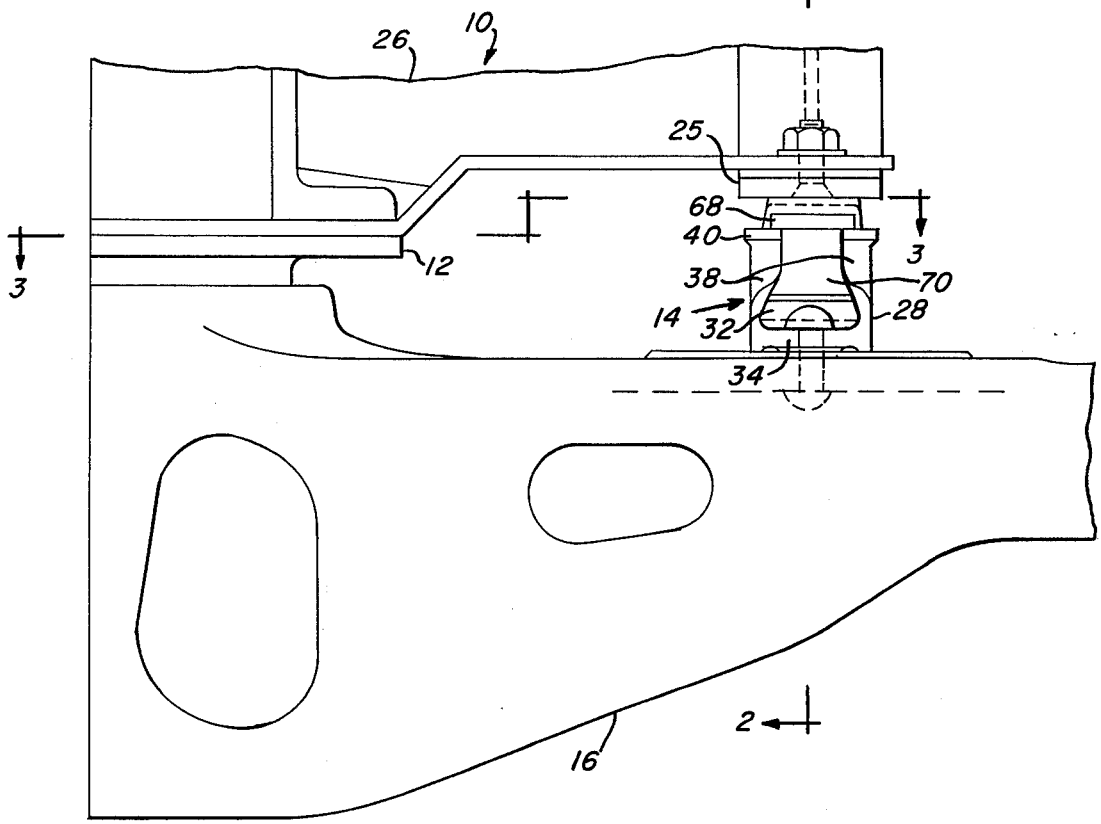
FIG. 1 is a partial schematic and side elevational view of a railway car assembly having a first embodiment of a side bearing assembly constructed according to the principles of the present invention disposed intermediate the car body and truck bolster.
Figure 2:
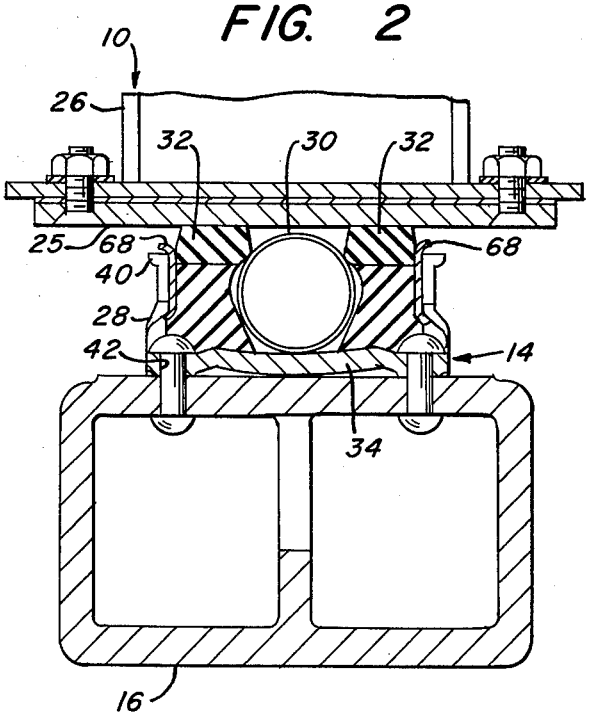
FIG. 2 is an end cross-sectional view taken on line 2—2 of FIG. 1.
Figure 3:
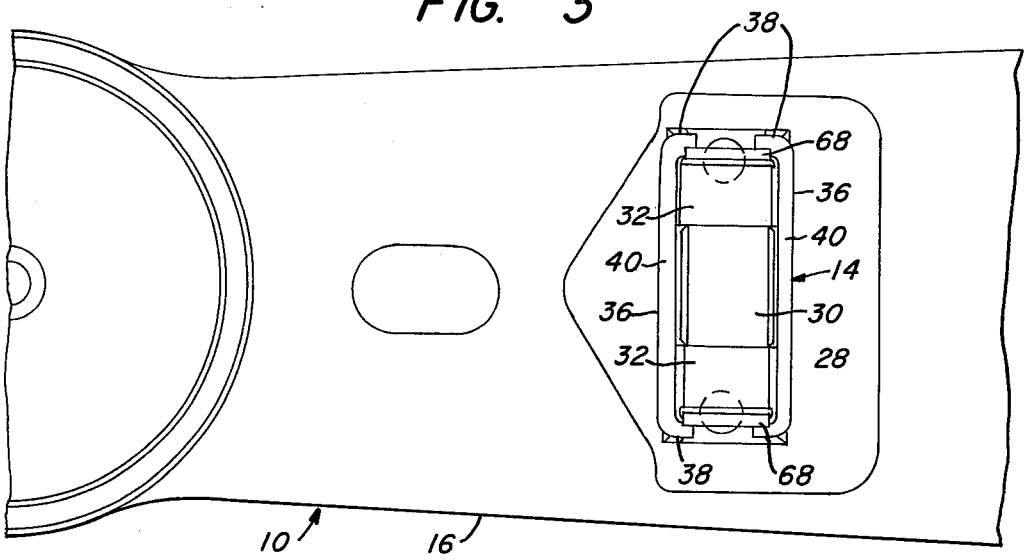
FIG. 3 is a plan view taken on line 3—3 of FIG. 1.
Figure 5:
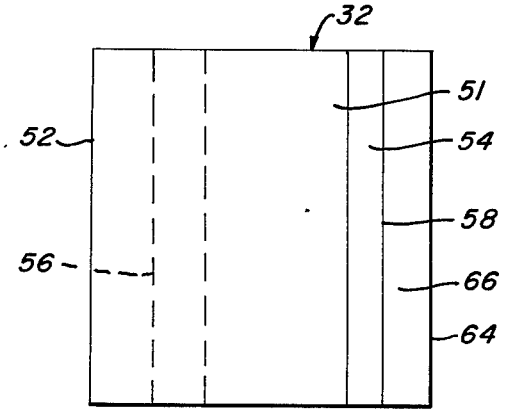
FIG. 5 is a plan view of the insert illustrated in FIG. 4.
Figure 4:
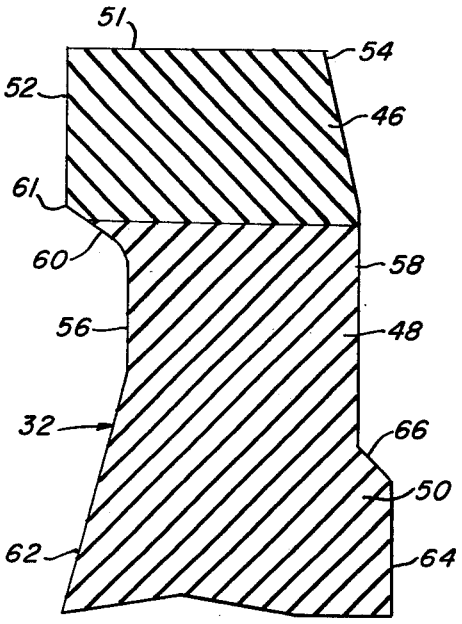
FIG. 4 is an enlarged side view of an elastomeric insert constructed in accordance with the principles of the present invention.

FIGS. 1 and 2 illustrate a fragmentary portion of a four-wheel railway freight car assembly, generally illustrated at 10, comprising; a center plate 12 and side bearing assemblies 14 of the present invention which cooperate with a bolster 16 to support the car body 26. Well-known spring groups are mounted in a pair of side frames (not shown) to support the bolster 16. Suitably journaled wheels which rest on tracks (not shown) support each side frame in a well known manner. Wear plates 25 are carried by car body 26 for engagement with each side bearing 14.

Inasmuch as the invention herein is primarily directed to side bearing assemblies 14 and the balance of the elements set forth hereinabove are well known in the art further description of such elements will not be set forth hereinafter except where necessary to describe side bearing assembly 14.

Side bearing assembly 14 comprises: an elongated bearing channel 28; a cylindrical rolled steel bearing 30 disposed within channel 28; and a pair of spaced elastomeric bearing blocks 32 each of which is disposed in channel 28 intermediate bearing 30 and the respective axial end of channel 28. Bearing channel 28 includes a longitudinal extending base 34 and a pair of transversely spaced side walls 36 depending upwardly from and extending along the sides of portion 34. The respective longitudinal end portions 38 of sidewalls 36 turn inwardly towards the longitudinal centerline of base 34. As shown portions 38 include an upper generally vertical section 39 and a lower section 41 which extends downwardly and tapers slightly outwardly from section 39. A peripheral flange 40 depends outwardly from each sidewall 36 adjacent the uppermost end thereof. In assembly, the longitudinal extent of channel 28 is disposed transversely of the longitudinal extent of bolster 16 and is affixed thereto in any suitable manner, for example, by suitable bolts or rivets or the like which extend through longitudinally spaced bores 42 in base 34.

Bearing 30 has an axial length thereof slightly less than the transverse distance between sidewalls 36 and the diameter of bearing 30 is greater than the depth of sidewalls 36. In assembled position, the axis of bearing 30 extends transversely of the longitudinal axis of channel 28 and a portion of the circumferential periphery of bearing 30 is in rolling engagement with an adjacent portion of the uppermost surface of base 34.

Each vertically elongated bearing block 32 includes upper, intermediate and lower portions respectively designated 46, 48 and 50. For descriptive purposes hereinafter inner and outer when referring to bearing blocks 32 shall mean toward and away from bearing 30 when blocks 32 are in an assembled position within a side bearing 14. Upper portion 46 is of a generally rectangular configuration having a generally vertically extending inner surface 52 and an outer surface 54 thereof which tapers slightly vertically inwardly from the lowermost end portion thereof. Intermediate portion 48 includes generally vertically extending inner and outer surfaces 56 and 58 respectively. Inner surface 56 is generally parallel to surface 52 and spaced outwardly therefrom and is integral therewith by a tapered transition surface 60 which extends therebetween. The area of transition between surface 60 and surface 52 defines the bearing abutment surface 61. Outer surface 58 extends vertically downwardly from the lowermost end of surface 54. Lower bearing block portion 50 includes a tapering inner surface 62 which tapers downwardly and inwardly from the lowermost end of surface 56 in a manner that the uppermost end thereof is adjacent surface 56 and the lowermost end thereof lies in a vertical plane that contains surface 52. The outer surface 64 of portion 50 extends generally vertically and is generally parallel to and spaced outwardly from surface 58 and is integral therewith by a tapered transition surface 66 which extends therebetween.

In addition to the configuration described hereinabove the transverse profile of portion 46 normal to surfaces 52 and 54 has a generally convex configuration and the transverse profile of portions 48 and 50 normal to the respective inner and outer surfaces thereof has a continuous generally concave configuration. As will become apparent hereinafter such convex and concave configuration aids deformation ability of the assembled bearing blocks 32.

To assemble a side bearing assembly 14, the bearing 30 is disposed within the channel 28 and thereafter an elastomeric bearing block 32 is disposed within channel 28 intermediate bearing 30 and adjacent pairs of end portions 38. To aid in assembly and retention of bearing blocks 32 within assembly 14 shim plates 68 are provided which are inserted intermediate the respective outer surfaces of bearing blocks 32 and end portions 38. Shim plates 68 additionally aid in operational characteristics of the side bearing assembly 14 by preventing the elastomer of the bearing blocks 32 from extruding between end portions 38 of sidewalls 36. As illustrated, shim plates 68 includes: a main plate portion 70 which, as illustrated, has a width slightly less than the transverse distance between the sidewalls 36 and a length slightly greater than the vertical extent of section 39; and upper and lower outwardly extending flange portions 72 and 74, respectively. In assembled position the upper flange portion 72 of shim plates 38 is seated on longitudinal end portions of peripheral flange 40 and the lower flange portion 74 is adjacent the transition between sections 39 and 41.

The bearing channel 28 illustrated and described herein is of the configuration generally used on the vast majority of railway freight cars in use today. Inasmuch as it is one object of the present invention to provide means to retrofit existing side bearings to obtain the advantages of the present invention various dimensional and configuration criteria of the illustrated embodiment are specifically for such retrofit requirements. Accordingly, it is to be understood that modifications to the embodiment of the bearing blocks illustrated can be readily made for alternative bearing channel configuration to achieve totally new configurations of side bearing assemblies. Furthermore, it is anticipated that upon knowledge of the invention herein various configuration modifications can be made to the embodiment described hereinabove either in retrofit or new side bearing configurations without departing from the scope of the invention.

Figure 7:
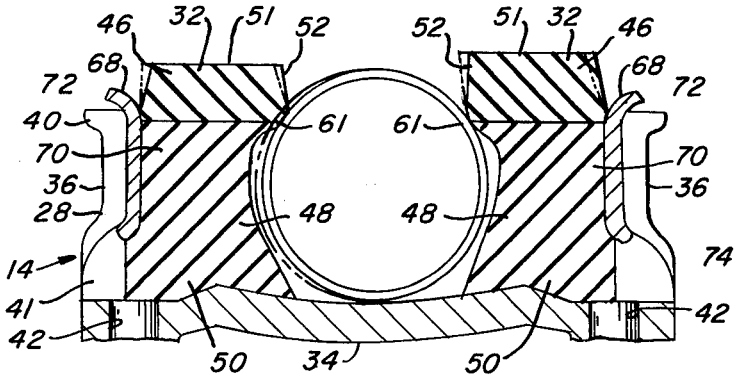
FIG. 7 is a schematic representation illustrating operating characteristics of the side bearing assembly of the present invention when assembled in a railway freight vehicle which is operating under various parameters.

FIG. 7 illustrates a side bearing assembly 14 under various operational criteria. The right hand block 50 in FIG. 7 primarily illustrates a situation when the side bearing assembly 14 is positioned in a railway car and with swiveling conditions illustrated in phantom. The left hand block 32 in FIG. 7 primarily illustrates a situation when the side bearing assembly 14 is in position in a loaded or unloaded railway car traveling under dynamic loading deflected vertically to the roller contact limit and with swiveling conditions illustrated in phantom.

Figure 6:
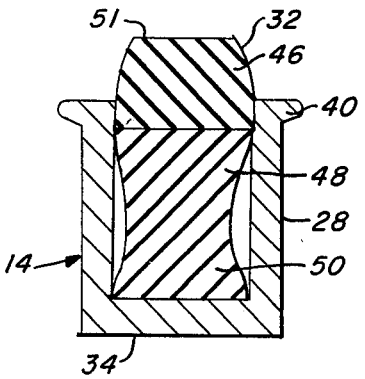
FIG. 6 is an end view of the insert illustrated in FIG. 4 with such insert being assembled in a bearing channel.

As illustrated in FIG. 7 the right hand block 32 under non-swiveling conditions has the upper surface 51 thereof spaced upwardly from the upper surface of bearing 30; the bearing abutment surface 61 engaging the bearing 30; the outer surface 58 of block 50 spaced slightly inward from the adjacent shim plate 68; and, as seen in FIG. 6, contact between the bearing channel side walls 36 and the block 32 occurs adjacent the upper end of sidewalls 36 at the transition of the convex and concave portions of the transverse sides of the block 32 and such contact between sidewalls 36 and block 32 additionally occurs adjacent the lower ends thereof. It is to be noted that the above described limited lateral restraint but limited contact between block 32 and channel 28 permits lateral expansion and allows additional vertical displacement of block 32 as described hereinafter when the railway car is traveling under dynamic conditions.

With the right hand block 32 supported as described hereinabove the block 32 will deform along the longitudinal extent of side bearing 14 as illustrated in phantom in FIG. 7 when an empty railway car is traveling at a high speed and hunting or oscillating in a horizontal plane. The contact between the bearing block 32 and the wear plate 25 is maintained by frictional engagement throughout the normal operation of the freight car on a straight or gradually curved track, which are the primary areas of concern with respect to hunting thereby effectively controlling hunting within acceptable limits by frictional engagement. In other words, blocks 32 prevent hunting by providing a sufficiently rigid shearing constraint at the side bearings within a predetermined acceptable shear force limit. The maximum shear force is limited to the friction between blocks 32 and wear plate 25 and is sufficient to inhibit hunting but still allow tracking when the railway car is traveling around sharp curves. In other words when the railway car is traveling around sharp curves the friction between blocks 32 and wear plate 25 is overcome. The maintenance of the above mentioned shearing constraint between blocks 32 and wear plate 25 is accomplished primarily through the maintenance of the unsupported length of the blocks 32 above the channel 28 being in the range of ¾ inch to 1-¾ inch. Still further, the compression modulus of the elastomer of at least the upper portion of the blocks 32 has been found to be of critical importance and under normal circumstances a modulus of elasticity (unit stress per unit strain) in the range of 7,000 to 20,000 psi has been found to be acceptable. The resulting horizontal shear constant per side bearing largely determined by the stiffness of the upper portion must be at least 15,000 pounds per inch for acceptable hunting control. Elastomer, hardness of the upper portion of the block corresponding to this compression and shear stiffness will vary. However, for proper operation and longevity and a hardness in a range of 54 to 60 Shore D has been found acceptable. The right hand block illustrated in FIG. 7 is applicable for static or non-dynamic loaded and non-loaded operating conditions and during such travel the upper surface of blocks 32 are consistently spaced upwardly from bearing 34.

The construction and material considerations of block 50 discussed hereinabove have been found to be of equal importance in restraining transverse oscillation of the car body in a direction of normal to the direction oscillating during hunting. This transverse oscillation occurs as a result of the wheelset or truck hunting and a soft constraint will lower the speed at which car body oscillation becomes severe and, in a similar manner, the blocks 32 of the present invention will control such transverse oscillation within acceptable limits by frictional engagement and the lateral shear stiffness of the upper portion.

In order to provide the above mentioned hardness and modulus of elasticity characteristics to provide stiffness in shear to prevent hunting but still maintaining an ability of the blocks 32 to compress vertically for dynamic and preload conditions, the blocks 32 in the preferred embodiment discussed hereinabove are illustrated as being molded of elastomeric materials having different characteristics. As illustrated the upper portion 46 of the bearing blocks 32 are constructed of a relatively hard material having the characteristics mentioned hereinabove and the lower portions 48 and 50 are constructed of a relatively softer material, for example in a typical polyurethane compound having a compression modulus of elasticity (unit stress per unit strain) in the range of 3,000 to 6,000 psi, and a hardness in the range of 43 to 51 Shore D. Although the particular ratio of hard to soft material with respect to the overall vertical height of the block 32 is illustrated as being approximately 1 to 2, other ratios are contemplated so long as the lower end portion of the upper portion is restrained within the bearing channel 28. For example, an elastomeric block having the upper 1/6 to ⅓ thereof of a harder elastomer and having the lower 5/6 to ⅔ thereof of a softer elastomer is contemplated. This restraint prior to the point of material transition is necessitated to retain the transverse deflection within acceptable limitations. Insofar as specific materials it has been found by experimentation that inasmuch as the upper portion of block 32 is to be stiff in compression and shear to limit heat generation and surface wear a material such as a hard urethane is most suitable and inasmuch as the lower portion must be readily susceptible to deflection and hence have a lower hysteresis, an elastomeric material like natural rubber is most suitable. Varying conditions dictate that a ratio of the compression stiffness of the upper portion of block 32 to the lower portion thereof which is in the range of 2 to 1 to 4 to 1 are contemplated. Most elastomeric material including urethane relax or exhibit initial creep under load. Accordingly, the above discussed properties are considered to exist after an initial relaxation period at room temperatures.

As further illustrated in FIG. 7 the left hand block 32 under non-swiveling conditions has the upper surface 51 thereof lying in the same plane with the upper surface of bearing 30; the bearing abutment surface 61 is in firm deformed compression engagement with bearing 30; the outer surface 58 of block 50 is in firm engagement with the adjacent shim plate 68; and the contact between block 32 and sidewalls 36 is firm adjacent the ends of the convex portion of block 32 and the degree of concavity is reduced by the deformed elastomer from the degree of concavity non-dynamic condition illustrated at FIG. 6. The wear plate 25 is in frictional engagement with the bearing block 32 and also in rolling engagement with bearing 30. The bearing 30 is operative for small swiveling motion under severe vertical loads without necessitating breaking the friction between the bearing 30 and the wear plate. The transverse offset between the inner surfaces 52 and 56 of bearing block 32 eases movement of the bearing 30 during swiveling and provides a space for the elastomer to readily deform into. obviously, if such offset surfaces or a suitable concaved area were not provided the rolling movement of bearing 30 would be more inhibited, although the roller can readily compress either block to accommodate small rolling excursions. At this point it is to be noted that the inner surface of intermediate portion 48 of block 30 can be altered from the configuration illustrated therein to any concave configuration which will result in substantial contact between the roller and elastomer elements on or near the upper portion of the elastomer. In practice, truck swivel resulting in a roll of bearing 30 of approximately a one-fourth inch in either direction has been found to be sufficient to accommodate most freight car designs on higher speed curved track. The roller motion accommodates minor swiveling with less resistance than the more rigid side bearing devices commonly known in the art thereby decreasing the problems of wheel flange wear, rail wear, train resistance and derailments which are all known to occur when rigid constraints are applied to swiveling in freight cars operating in dynamic conditions.

In addition to the modifications discussed hereinbefore other modifications can be made to the preferred embodiment described hereinabove without departing from the scope of the invention, for example: the surfaces of bearing blocks 32 adjacent bearing 30 can be impregnated with particles of teflon or molydisulfide to facilitate relative movement between blocks 32 and bearing 30; a plurality of bearings 30 can be disposed between spaced blocks 32; aternative configurations of bearing blocks 32 and channel 28 are anticipated; the side bearing assemblies can be constructed without the use of shim plates 68; a rigid member can be disposed in channel 28 intermediate bearing 30 and each block 32 to facilitate in the motion of the roller bearing 30; block configurations other than polygonal is anticipated, for example cylindrical; continuous peripheral support of the blocks 32 by the channel 28 is not required; and the like.

Figure 8:
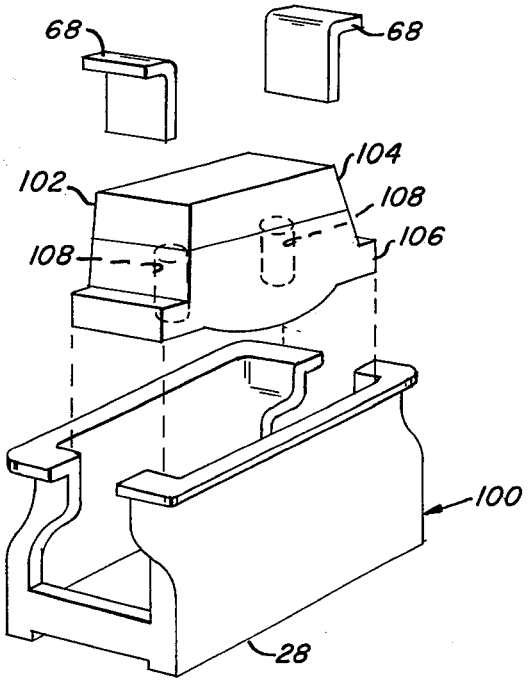
FIG. 8 is an exploded projected view of another embodiment of a side bearing constructed in accordance with the principles of the present invention.

It is to be further noted that inasmuch as the invention herein additionally teaches the concept of an elastomeric block unitarily constructed of an upper portion of hardened elastomer and a lower portion of relatively softer elastomer with the lower portion confined and supported and the transition of the soft elastomer to the hard elastomer being at a point substantially no lower than the confining structure, as conditions dictate such a concept can be utilized in the construction of an elastomeric side bearing which would control truck hunting and would have no bearing therein. Such an alternative side bearing assembly 100 is illustrated in FIG. 8 and as shown comprises: an elongated bearing channel 28 which receives therein a single elastomeric bearing block 102 when assembled shim plates 68 are received within channel 28 intermediate bearing block 102 and respective pairs of end portions 38. Inasmuch as channel 28 and shim plates 68 were discussed hereinbefore with respect to bearing assembly 100, reference is made to such previous discussion for a detailed description thereof. Bearing block 102 includes upper and lower portions 104 and 106, respectively. Portion 104 is similar in physical and chemical characteristics to upper portion 46 of block 32 and portion 106 has similar physical and chemical characteristics to lower portions 48 and 50 discussed hereinbefore. Likewise, the operating parameters and ratio relationships discussed hereinbefore with respect to portions 46 and 48–50 are respectively applicable to portions 104 and 106.

In assembly lower portion 106 and at least the transition between portions 106 and 104 is received within channel 28 and portions of the sides and ends of block 102 engage adjacent ends and sides of channel 28. The operational characteristics of side bearing assembly 100 is substantially identical to assembly 14 discussed hereinbefore with the primary distinction therebetween being that bearing assembly 14 includes a roller side bearing therefor offering the ability of potentially superior swiveling at impact loading. A further operational distinction between side bearing assembly 100 and assembly 14 resides in the fact that block 102 includes a plurality of spaced downwardly open upwardly extending blind bores 108 in the lower portion 106 thereof. Under load conditions the bores 108 offer interior space for the deformation of the elastomer thereby reducing lateral loading on channel 28 and maintaining a more uniform load distribution. It is to be noted that bores such as bores 108 can be included in blocks 32 and in such event, in addition to the advantages discussed above, the material deforming into the spaces provided by bores 108 decreases resistance to the movement of roller bearing 30.

The description herein does not limit the scope of the invention and the invention is defined by the scope of the claims set forth hereinafter.

What is claimed is:

1. A railway vehicle side bearing assembly adapted to be disposed intermediate a bolster and car body of a railway vehicle comprising: an elongated upwardly open housing; roller bearing means received within said housing; elastomeric bearing means received within said housing intermediate each axial end of said housing and said roller bearing means; the uppermost surface of said elastomeric bearing means is spaced upwardly from the uppermost surface of said roller bearing means when said elastomeric bearing means is in the uncompressed state thereof and when first loadings are directed to such a side bearing during operation of such a railway vehicle; said uppermost surfaces of said roller bearing means and elastomeric bearing means being spaced upwardly from the uppermost surface of said housing; and said elastomeric bearing means being of a configuration and stiffness to engage such a car body and maintain a spacing between said roller bearing means and such a car body and when such first loadings are directed to such a side bearing and to deform such that direct engagement of said elastomeric bearing means and said roller bearing means occurs with such a car body when second loadings, higher than such first loadings, are directed to such a side bearing.

2. A side bearing as specified in claim 1 wherein said elastomeric bearing means are captively received within said housing.

3. A side bearing as specified in claim 1 wherein said roller bearing means includes at least a portion thereof having a generally cylindrical configuration which is disposed within said housing in a manner that the axis thereof extends transversely of the longitudinal extent of said housing.

4. A side bearing as specified in claim 1 wherein each of said elastomeric bearing means include an upper portion and a lower portion with the ratio of the compression stiffness of the elastomer of said upper portion to the compression stiffness of the elastomer of said lower portion being in the range of 2 to 1 to 4 to 1 such that said upper portion is more resistant to heat decomposition and horizontal shear deformation than said lower portion while said lower portion affords a preferred resiliency to said elastomeric bearing means.

5. A side bearing as specified in claim 4 wherein the lower end of said portion is substantially no higher than the upper end of said housing.

6. A side bearing as specified in claim 5 wherein said upper portion is 1/6 to ⅓ of the total height of said elastomeric bearing means in said uncompressed state thereof to provide adequate operational clearances while simultaneously maintaining positive lateral confinement of said lower end of said upper portion.

7. A side bearing as specified in claim 1 additionally including shims captively received intermediate each of said elastomeric bearing means and the respective axial end of said housing adjacent thereto.

8. A side bearing as specified in claim 1 wherein the axis of rotation of said roller bearing means extends in a direction generally transverse to the longitudinal extent of said housing.

9. A railway vehicle side bearing assembly adapted to be disposed intermediate a bolster and car body of a railway vehicle comprising: an upwardly open housing; elastomeric bearing means received within said housing with the uppermost surface of said bearing means being spaced upwardly from said housing; said bearing means including an upper portion adapted to engage such a car body and a lower portion adapted to more readily deform than said upper portion in response to loadings applied to such a side bearing assembly; and the lower end of said upper portion being substantially no higher than the upper end of said housing.

10. A side bearing as specified in claim 9 wherein said upper portion is 1/6 to ⅓ of the total height of said elastomeric bearing means in the uncompressed state thereof to provide adequate operational clearances while simultaneously maintaining positive lateral confinement of said lower end of said upper portion.

11. A side bearing as specified in claim 9 wherein said lower portion includes at least one downwardly open upwardly extending bore therein.

12. A side bearing as specified in claim 9 wherein the ratio of compression stiffness of the elastomer of said upper portion to the compression stiffness of the elastomer of said lower portion is in the range of 2 to 1 to 4 to 1 such that said upper portion is more resistant to heat decomposition and horizontal shear deformation than said lower portion while said lower portion affords a preferred resiliency to said elastomeric side bearing.

13. An elastomeric bearing means adapted to be received within an upwardly open housing disposed intermediate a bolster member and car body member of a railway vehicle with the uppermost surface of said bearing means being spaced upwardly from such a housing comprising: an upper portion adapted to engage such a car body and a lower portion adapted to more readily deform than said upper portion in response to loadings applied thereto; and when said bearing means is received within such a housing the lower end of said upper portion is substantially no higher than the uppermost end of such a housing.

14. An elastomeric bearing means as specified in claim 13 wherein the ratio of compression stiffness of the elastomer of said upper portion to the compression stiffness of the elastomer of said lower portion is in the range of 2 to 1 and 4 to 1 such that said upper portion is more resistant to heat decomposition and horizontal shear deformation than said lower portion while said lower portion affords a preferred resiliency to said elastomeric bearing means.

* * * * *